US006090213A

United States Patent [19]

Moyers

[11] Patent Number: 6,090,213

[45] Date of Patent: Jul. 18, 2000

[54] ULTRASONIC PARTS CLEANING SYSTEM

[76] Inventor: Lee Moyers, 11904 County River Dr., Parrish, Fla. 34219

[21] Appl. No.: 09/095,087

[22] Filed: Jun. 10, 1998

[51] Int. Cl.[7] ..... B08B 3/12; B08B 5/04; B08B 9/00

[52] U.S. Cl. ..... 134/1; 134/21; 134/22.18; 134/30; 134/89; 134/95.2; 134/166 R; 134/169 R; 134/170; 134/171; 134/186

[58] Field of Search ..... 134/1, 21, 22.12, 134/22.18, 24, 30, 170, 171, 95.2, 166 R, 169 R, 88, 89, 152, 186

[56] References Cited

U.S. PATENT DOCUMENTS

| | | | |
|---|---|---|---|
| 2,141,516 | 12/1938 | Clements | 134/170 |
| 2,786,480 | 3/1957 | Hofer | 134/171 |
| 3,070,104 | 12/1962 | Faust et al. | 134/145 |
| 3,463,173 | 8/1969 | Goldman | 134/152 X |
| 3,590,863 | 7/1971 | Faust et al. | 134/170 X |
| 4,310,010 | 1/1982 | Sovboda | 134/170 X |
| 4,354,514 | 10/1982 | Sundheimer et al. | 134/152 |
| 4,708,153 | 11/1987 | Hambleton et al. | 134/170 |
| 4,820,351 | 4/1989 | Hambleton et al. | 134/21 |

*Primary Examiner*—Randy Gulakowski
*Assistant Examiner*—Saeed Chaudhry
*Attorney, Agent, or Firm*—Duane, Morris & Heckscher LLP

[57] ABSTRACT

An automated cleaning system for parts is disclosed. The parts to be cleaned are elongated tubes closed on one end which are mounted upside down on nozzles on a fixture. The fixture is placed in a wash tank where cleaning fluid is forced through the nozzles and into the insides of the parts. Ultrasonic techniques are also employed to assist in the cleaning. The fixture is moved to the next tank where rinse fluid is forced through nozzles. Again, ultrasonic techniques are used in the rinse tank. The fixture is placed in the drying tank where heated air is circulated into the tank while a vacuum is applied to the nozzles to draw out the heated air through the nozzles. Humidity from ambient air is isolated by virtue of the heated inlet air to the drying tank and an operable lid on the dry tank. Numerous parts can be processed at once in an automatic system which provides an improved technique for cleaning the parts while shortening the cycle time for the entire process.

23 Claims, 4 Drawing Sheets

ULTRASONIC PARTS CLEANING SYSTEM

FIELD OF THE INVENTION

This invention relates to methods and devices for cleaning parts and more particularly, mounting techniques for the parts to convey them through the various cleaning steps and the manner in which the cleaning is accomplished.

BACKGROUND OF THE INVENTION

In a variety of manufacturing processes, parts must be cleaned prior to assembly or final manufacturing procedures. In the field of endoscopic or arthroscopic surgical devices, shavers are frequently used which involve counterrotating blades to accomplish the cutting. Shaver blades are produced in the form of elongated cylindrical tubes which generally have an open end onto which a hub is secured so that the blade may be attached to a hand piece and a closed end into which a cutting edge is formed. Before the cutting edges are formed at the distal tips of the tubes, the tubes must be cleaned. In the past, cleaning involved placing a handful of tubes into a tilted tank with cleaning solution and then rinsing the tubes in the clean water tank and shaking the water out of the tubes prior to placing the tubes into an oven with the open end down. This process was inefficient and took a great deal of time. If the tubes were not thoroughly clean, subsequent machining operations to form the distal tip of the tube were compromised, leading to defective products. Accordingly, an improved technique was needed to better accomplish the cleaning procedure, as well as to decrease the total time needed for the complete cleaning process. Accordingly, one of the objectives of the present invention is to provide support hardware to handle a large number of parts to be cleaned, wherein the hardware can be deployed through the various cleaning steps. Another objective of the present invention is to provide the support equipment for the parts so that the cleaning techniques could be accomplished more efficiently. Yet another object of the present invention is to combine washing with ultrasonic cleaning, as well as rinsing, followed by a positive flow drying system to assure adequate drying. These and other objectives of the present invention will become apparent to those of skill in the art from a review of the preferred embodiment described below.

SUMMARY OF THE INVENTION

An automated cleaning system for parts is disclosed. The parts to be cleaned are elongated tubes closed on one end which are mounted upside down on nozzles on a fixture. The fixture is placed in a wash tank where cleaning fluid is forced through the nozzles and into the insides of the parts. Ultrasonic techniques are also employed to assist in the cleaning. The fixture is moved to the next tank where rinse fluid is forced through nozzles. Again, ultrasonic techniques are used in the rinse tank. The fixture is placed in the drying tank where heated air is circulated into the tank while a vacuum is applied to the nozzles to draw out the heated air through the nozzles. Humidity from ambient air is isolated by virtue of the heated inlet air to the drying tank and an operable lid on the dry tank. Numerous parts can be processed at once in an automatic system which provides an improved technique for cleaning the parts while shortening the cycle time for the entire process.

DETAILED DESCRIPTION OF THE PREFERRED EMBODIMENT

Figure 1:
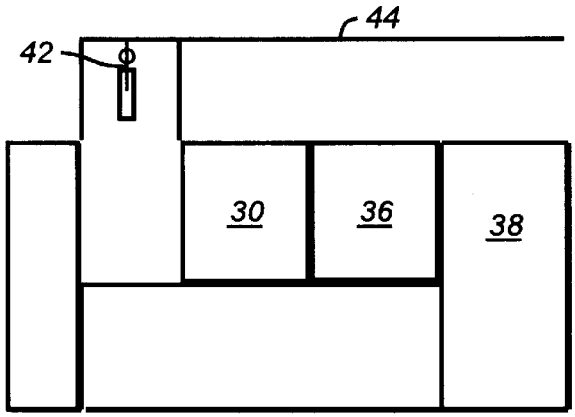
FIG. 1 is an elevational view of the components of the drying system.
Figure 2:
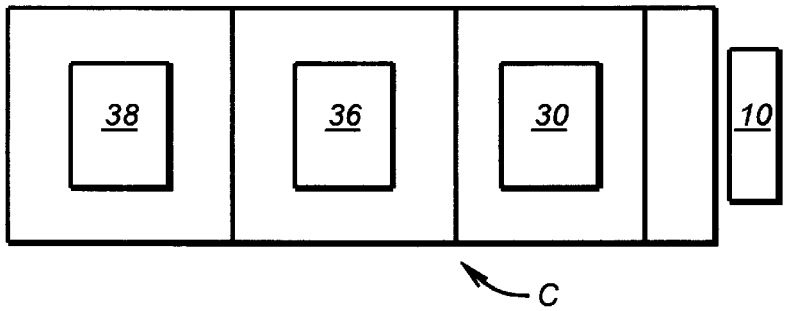
FIG. 2 is a plan view of FIG. 1.
Figure 3:
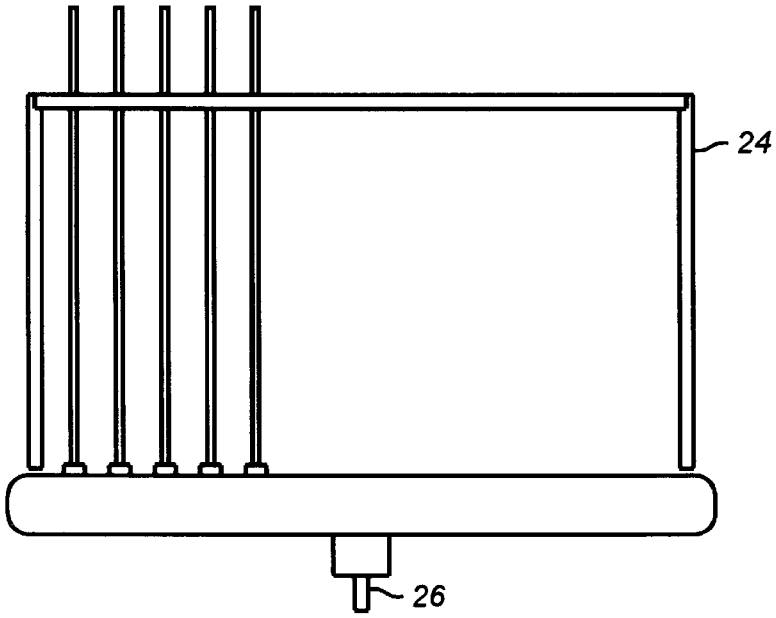
FIG. 3 is an elevational view of the fixture which supports the parts.
Figure 6:
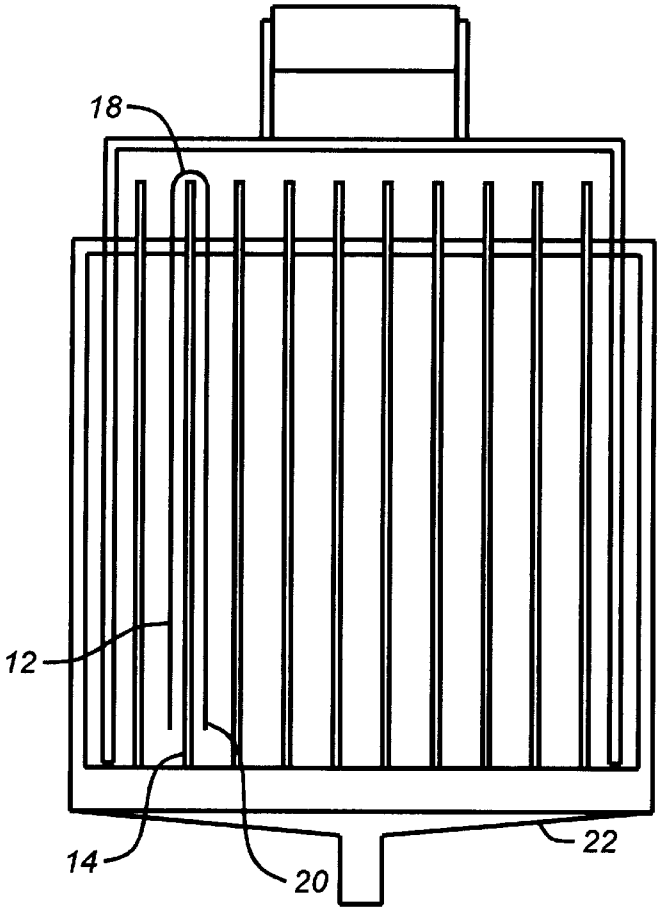
FIG. 6 is the view of FIG. 3, showing the parts mounted thereon.
Figure 5:
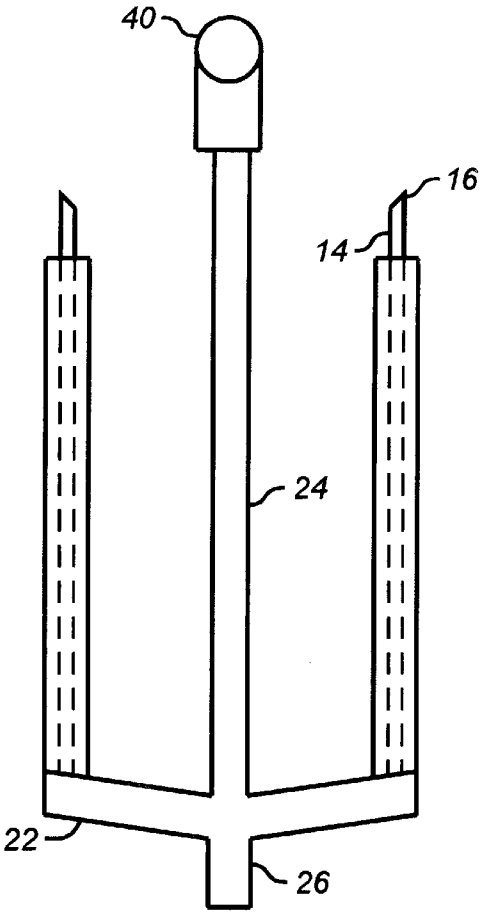
FIG. 5 is an end view of the fixture shown in FIG. 3.
Figure 7:
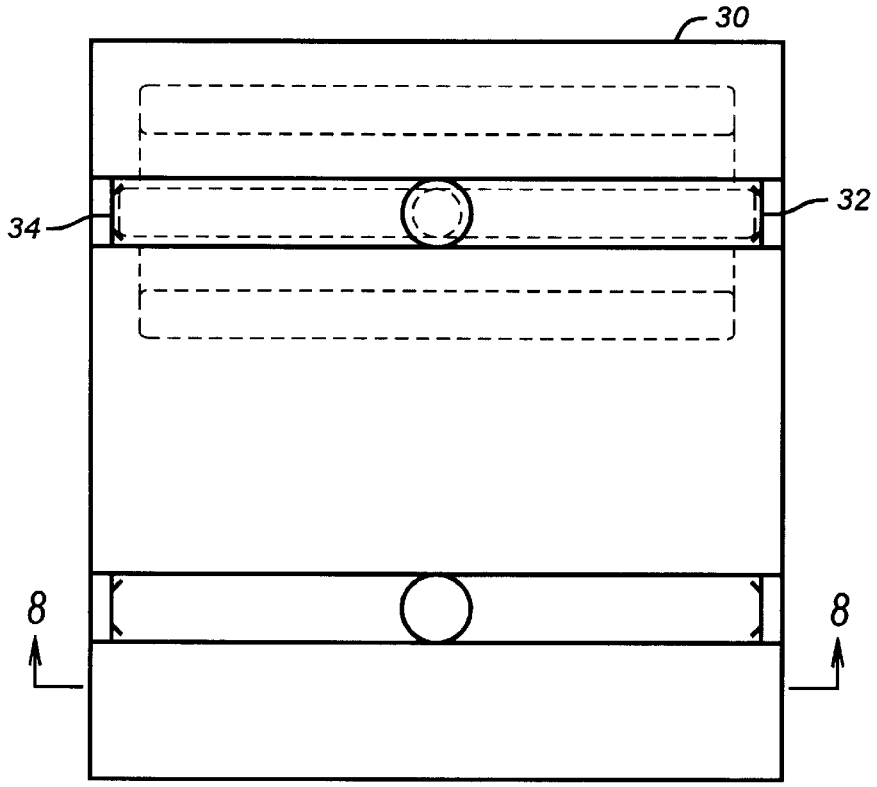
FIG. 7 is a plan view of one of the tanks used in the system, showing the guides for the fixture.
Figure 8:
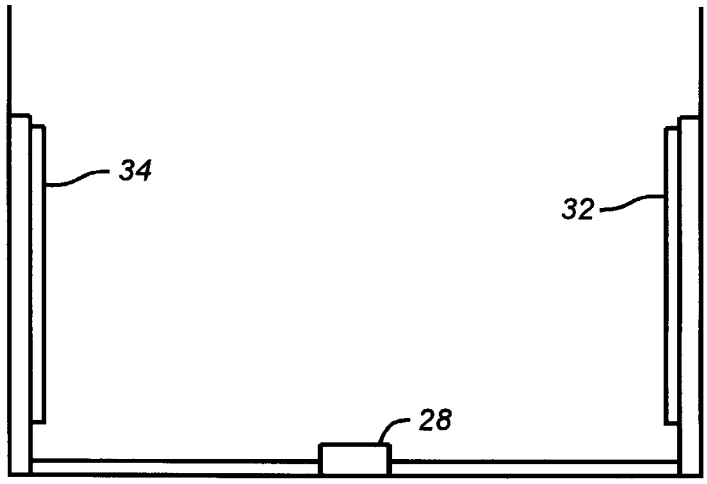
FIG. 8 is an elevational view along lines 8—8 of FIG. 7.

Referring to FIGS. 1 and 2, the overall layout of the cleaning system C is shown in FIG. 2 in plan. A staging area 10 is used to load the parts, preferably shaver tubes 12 (see FIG. 6) onto individual nozzles such as 14. As shown in FIG. 5, each nozzle 14 has an end 16 which comes to a point due to a slant cut preferably at about 45°. The shaver tubes 12 have closed ends 18 and an opposite open end 20. Each of the tubes 12 is placed upside down, as shown in FIG. 6, over an elongated nozzle tube 14. The nozzle tubes 14 are connected to a manifold 22. As shown in FIG. 5, the manifold 22 accommodates parallel rows of nozzles 14. As shown in FIG. 5, two parallel rows are envisioned. The manifold 22 is connected to a tubular frame 24, better seen in FIG. 3. The frame 24 is located between the parallel rows of nozzles 14. The manifold 22 has a bottom connection 26 which communicates with a port 28 (see FIG. 8) in a particular tank. Looking at FIGS. 7 and 8, a plan view of a wash tank 30 is illustrated. In the plan view of FIG. 7, guide channels 32 and 34 can be seen which engage the frame 24 to guide the bottom connection 26, which can be a male connection, into the female connection 28, shown at the bottom of FIG. 8. A similar guiding arrangement can be employed in each of the tanks 30, 36, and 38.

Looking at the overall layout, the initial tank is the wash tank 30, followed by the rinse tank 36, followed by the dry tank 38. FIG. 2 shows that the shaver tubes 12 can be loaded on the nozzles 14 adjacent to opposing sides of the staging area 10 to speed up the production.

Referring to FIG. 5, it can be seen that the frame 24 has a handle 40 which can be secured by a 360° swivel 42 (see FIG. 1). The frame 24 can then be lowered into the respective tanks after it is placed into position above them. Shown schematically in FIG. 1 is a rail 44 which allows the frame 24 with the shaver tubes 12 mounted to the nozzles 14 to be moved into position and lowered into tanks 30, 36, and 38 in series.

Figure 9:
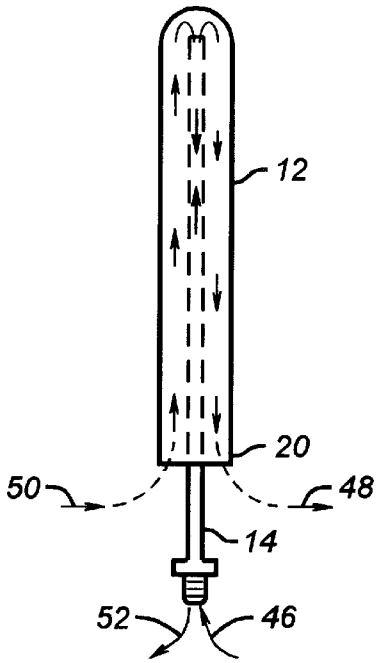
FIG. 9 is an individual view of a nozzle showing the part mounted thereon and the various flows during the washing and drying step.

Referring to FIG. 9, some of the operations are illustrated schematically with respect to a single nozzle 14. During the wash and rinse, arrow 46 represents the inlet of circulating fluid, while arrow 48 represents the exiting circulating fluid from within the shaver tubes 12. As can be seen, the flow is in through the nozzle 14, out the beveled top at end 16 which supports the shaver tube 12 at a point, and out through the annular space, down through the open end 20 of the shaver tube 12. When drying, the flow is reversed such that heated air is circulated as illustrated schematically by arrow 50. The heated air passes through the annular space between the nozzle 14 and the interior of the shaver tube 12 and then enters the nozzle 14, where it is pulled out by vacuum shown schematically as arrow 52.

Figure 4:
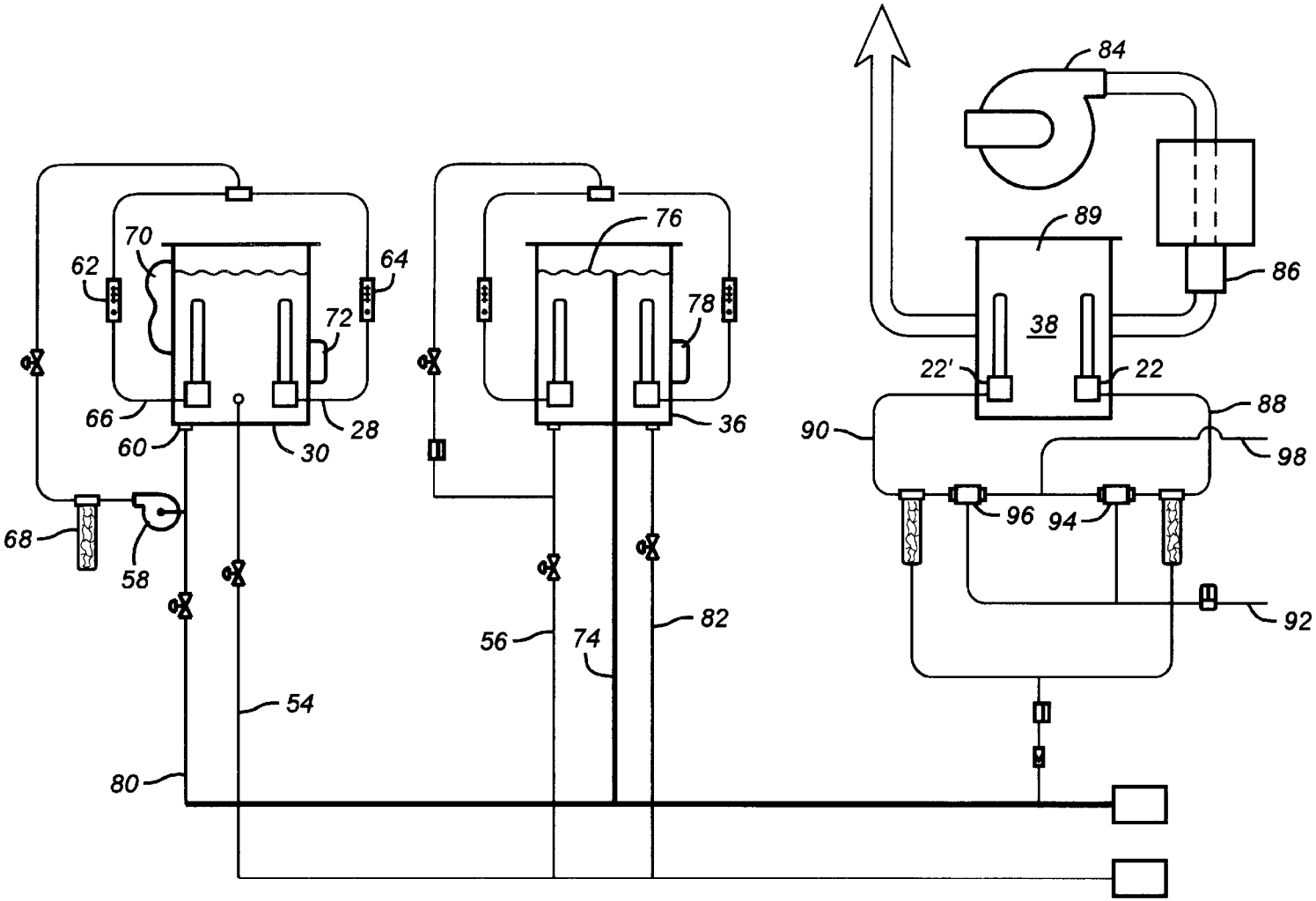
FIG. 4 is a plumbing schematic diagram for the component parts of the cleaning system.

FIG. 4 shows the plumbing arrangement for the wash tank 30, rinse tank 36, and the dry tank 38. Line 54 is a manual fill line for wash tank 30, while line 56 is the manual fill line for rinse tank 36. The wash tank 30 recirculates by virtue of pump 58, which draws from connection 60 in the bottom of wash tank 30 and returns through flow meters 62 and 64 into connections 28 and 66. It should be noted that the wash tank 30 is also shown in elevation in FIG. 8 where connection 28 is literally rather than schematically illustrated. In essence, each manifold that can fit into the wash tank 30 has a connection such as 26 (see FIG. 3) so that it can be respectively in fluid communication with connections 28 or 66 in the wash tank 30. A filter 68 filters the circulating fluid moved by pump 58. Item 70 illustrates schematically that the wash tank 30 is insulated and heated to facilitate the washing process, while item 72 illustrates the ultrasonics used in the washing process. In the preferred embodiment, 900 watts of 25 kHz ultrasonics are used which are delivered by a series of metallurgically attached, bottom-mounted piezoelectric transducers. A Neptune generator creates the drive signal which incorporates pulse sweep frequency tracking and square wave output. The heating is accomplished by 2000 watts delivered by side-mounted external strip heaters. Referring now to the rinse tank 36 in FIG. 4, an overflow line 74 assures a level 76 in the rinse tank 36. Line 56 is used to fill up rinse tank 36. Ultra-sonics are appended to the rinse tank 36 and shown schematically as 78. Lines 80 and 82 are used to, respectively, drain wash tank 30 and rinse tank 36.

Connected to the dry tank 38 is a blower 84 which blows through a heater 86 into dry tank 38. Dry tank 38 has a pivoting lid 89so that the air circulated by blower 84 is forced into open ends 20 of shaver tubes 12 and into the passage of nozzles 14 (see FIG. 6). Manifolds 22 and 22' are illustrated in the dry tank 38 and are, respectively, connected to lines 88 and 90. Line 92 is connected to a source of compressed air which branches to connect to eductors 94 and 96. Eductors 94 and 96 pull a vacuum on lines 88 and 90 to urge exhaust from dry tank 38 through common discharge line 98. Thus, it can be seen from FIG. 4 that to dry the shaver tubes 12, each of which is mounted open end 20 down on a nozzle 14 (see FIG. 6), the blower 84 is activated through heater 86 while at the same time compressed air is supplied through line 92 to eductors 94 and 96. Exhaust is drawn by the vacuum created by eductors 94 and 96. While this is going on, a hinged lid 89 is closed so as to hold in the heat and assist in the drying and at the same time to direct the output of blower 84 toward the nozzles 14 so that eductors 94 and 96 can exhaust air or any other gas used and any moisture from within the shaver tubes 12 out to a remote location through common exhaust line 98.

A typical procedure for cleaning the shaver tubes 12 is to mount them on the respective nozzles 14 and insert them into wash tank 30. Wash tank 30 is circulated with pump 58 for about a minute, and the pump 58 is then shut off. Thereafter, the ultrasonic unit 72 is turned on for approximately 3 minutes and then turned off. The pump 58 is then turned on again for approximately a minute, marking the end of the wash cycle. In the rinse tank 36, the automatic cycle comprises of filling the tank and turning on the ultrasonic unit 78 for approximately 3 minutes, followed by further filling of the rinse tank 36 as excess fluid drains to overflow line 74. Thereafter, the shaver tubes 12 are put into the dry tank 38 where blower 84 and eductors 94 and 96 are operative in conjunction with heater 86 for approximately 3 minutes with lid 89 closed. The heater 86 is then turned off while the blower 84 and eductors 94 and 96 continue to operate for approximately 2 minutes, at which time all of the equipment is shut off and the shaver tubes 12 are fully dry and can be removed from the dry tank 38 after opening lid 89.

Those skilled in the art can see that the system provides an economical yet efficient way to clean large quantities of parts, particularly elongated parts with internal surfaces which are hard to reach by hand and cannot be as efficiently cleaned by traditional soaking methods. The wash cycle of the present invention in tank 30 involves forced circulation through the nozzles 14 to the inside surfaces of the shaver tubes 12, coupled with ultrasonic techniques to facilitate the cleaning operation. Ultrasonic techniques are also used in combination with clean water soaking to complete the cleaning operation in rinse tank 36. Finally, the drying procedure reverses the flow through the shaver tubes 12 as heated dried air is forced into the covered dry tank 38 and exhausted through nozzles 14 with the aid of eductors 94 and 96. Numerous rows of nozzles can be used on a given manifold and the configuration of the tanks can accommodate the quantities needed to be washed and dried for a particular operation.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of cleaning elongated tubularly shaped parts, comprising:

mounting the parts on a frame in a wash tank to separate them from each other;

mounting said parts on said frame on upwardly extending supports with an open end of said parts downwardly oriented;

providing a fluid pathway through said supports so that they act as nozzles;

applying pumped cleaning fluid to said parts through said nozzles;

ultrasonically cleaning the parts in said wash tank while stopping said pumping; and allowing said parts to dry.

2. The method of claim 1 further comprising:

applying cleaning fluid through the interior of said parts through said nozzles.

3. The method of claim 2, further comprising:

placing the parts in a closable dry tank to dry them;

closing off said dry tank to isolate its interior from the surrounding room air.

4. The method of claim 3, further comprising:

blowing heated gas into the tank;

pulling gas out of the tank through said nozzles.

5. The method of claim 4, further comprising:

circulating said heated gas into an open end of the tubularly shaped parts;

using a vacuum device to pull said heated air into said nozzles;

removing liquid from said parts by said vacuum device.

6. The method of claim 2, further comprising:

putting said parts into a wash tank having a fluid inlet connection;

providing a connection on said frame to provide fluid communication to said nozzles;

guiding said frame in said wash tank;

mating said fluid inlet connection to said connection on said frame as said frame is guided into said wash tank.

7. The method of claim 2, further comprising:

forming the tips of said nozzles so as to allow fluid and gas circulation through the interior of the parts while said tips support the parts.

8. The method of claim 6, further comprising:

guiding said frame in a rinse tank;

providing a fluid inlet in said rinse tank;

guiding said connection on said frame to connect with said fluid inlet on said rinse tank.

9. The method of claim 8, further comprising:

guiding said frame in a dry tank;

providing a connection in said dry tank;

guiding said connection on said frame to mate with said connection on said dry tank.

10. The method of claim 9, further comprising:

blowing heated gas into said dry tank with the parts therein;

closing a lid on said dry tank;

moving said heated gas out of said dry tank through said nozzles.

11. The method of claim 10, further comprising:

inducing gas to flow through said nozzles by pulling a vacuum from outside said dry tank through said connection thereon.

12. The method of claim 2, further comprising:

extending each nozzle the length of each part on its interior;

creating an annular space within each part between the exterior of each nozzle and the interior of each part.

13. The method of claim 12, further comprising:

flowing wash fluid in a first direction in said annular space;

flowing heated gas in a second direction opposite said first direction through said annular space.

14. The method of claim 13, further comprising:

blowing heated gas into a dry tank;

closing a lid on said dry tank to allow said blown gas to move through said annular space in said second direction for exit from said dry tank.

15. The method of claim 14, further comprising:

applying a vacuum to said nozzles to induce said gas, with removed fluid from said parts, to exit said dry tank through said nozzles.

16. The method of claim 15, further comprising:

cutting away the ends of said nozzles to provide an open passage at each nozzle tip into said annular space for gas and liquid.

17. A method of cleaning elongated tubularly shaped parts, comprising:

mounting the parts on a frame to separate them from each other;

applying cleaning fluid to said parts;

allowing said parts to dry;

mounting said parts on said frame on upwardly extending supports with an open end of said parts downwardly oriented;

providing a fluid pathway through said supports so that they act as nozzles;

applying cleaning fluid to the interior of said parts through said nozzles;

putting said parts into a wash tank having a fluid inlet connection;

providing a connection on said frame to provide fluid communication to said nozzles;

guiding said frame in said wash tank;

mating said fluid inlet connection to said connection on said frame as said frame is guided into said wash tank;

filling said wash tank;

pumping fluid through said nozzles;

ultrasonically cleaning the parts in said wash tank while stopping said pumping.

18. The method of claim 17, further comprising:

placing said parts in a rinse tank after said wash tank;

filling said rinse tank;

ultrasonically cleaning said parts;

moving said parts to a dry tank.

19. The method of claim 18, further comprising:

using separate fluid systems to said wash and rinse tanks.

20. A washer apparatus for elongated parts, having one open end and one closed end, comprising:

a tank having at least one compartment;

a frame comprising at least one upwardly oriented tube extending from a manifold, said tube supporting a part by extending through its open end to adjacent its closed end, said tube capable of delivering fluid into the part to clean it; and an ultrasonic energy device to clean the part in the tank when the part is in fluid.

21. The apparatus of claim 20, further comprising:

an enclosure on said tank;

a blower to push heated gas into said tank;

a vacuum device to pull gas with liquid through said tube and out of said tank during drying of the part.

22. The apparatus of claim 21, wherein:

said tank contains a connection;

said manifold having a fitting which mates up with said connection on the tank when said manifold is put into said tank.

23. The apparatus of claim 22, wherein:

said frame is guided in said tank to facilitate alignment of said fitting with said connection.

* * * * *